United States Patent [19]

Mantani

[11] 4,002,095

[45] Jan. 11, 1977

[54] WAVEFORM CONVERTER FOR USE WITH AN ELECTRONIC MUSICAL INSTRUMENT AND CAPABLE OF CONTROLLING THE DUTY FACTOR OF A RECTANGULAR WAVE TONE SIGNAL

[75] Inventor: Rokurota Mantani, Hamamatsu, Japan

[73] Assignee: Nippon Gakki Seizo Kabushiki Kaisha, Japan

[22] Filed: Nov. 7, 1975

[21] Appl. No.: 629,919

[30] Foreign Application Priority Data

Nov. 13, 1974 Japan ..... 49-129855

[52] U.S. Cl. ..... 84/1.01; 84/1.22; 84/1.24

[51] Int. Cl.[2] ..... G10H 1/06; G10H 1/02

[58] Field of Search ..... 84/1.01, 1.17, 11.1, 84/1.19, 1.22, 1.24

[56] References Cited

UNITED STATES PATENTS

| | | | |
|---|---|---|---|
| 3,775,545 | 11/1973 | Tsukamoto et al. | 84/1.22 |
| 3,803,338 | 4/1974 | Adachi | 84/1.11 |
| 3,821,457 | 6/1974 | Petrie | 84/1.01 |

*Primary Examiner*—E. S. Jackmon

*Attorney, Agent, or Firm*—Flynn & Frishauf

[57] ABSTRACT

A waveform converter for an electronic musical instrument wherein an input rectangular wave tone signal is supplied to a frequency-voltage converter to generate a D.C. voltage control signal having a voltage level corresponding to the frequency of the input rectangular wave tone signal; and a one-shot multivibrator is triggered by the input rectangular wave tone signal to produce an output rectangular wave tone signal having the same frequency as the input rectangular wave tone signal. The one-shot multivibrator comprises duty factor control means responsive to the D.C. control voltage signal for determining the duty factor of the output rectangular wave tone signal.

2 Claims, 6 Drawing Figures

WAVEFORM CONVERTER FOR USE WITH AN ELECTRONIC MUSICAL INSTRUMENT AND CAPABLE OF CONTROLLING THE DUTY FACTOR OF A RECTANGULAR WAVE TONE SIGNAL

BACKGROUND OF THE INVENTION

This invention relates to a waveform converter used with an electronic musical instrument and capable of controlling the duty factor of a rectangular wave tone signal.

With a conventional electronic musical instrument, key depression causes tone signals to be selectively taken from tone generators. In this case, the tone signals are given desired tone colors by tone-coloring filters. The tone signal generators are formed of a master oscillator and a frequency divider chain consisting of cascade-connected bistable multivibrators. Tone signals produced by the tone generators have a rectangular wave and a duty factor whose value is chosen to be 50%.

When voiced by the same type of tone-coloring filter, rectangular wave tone signals having a 50% duty factor and those having other duty factors present different tone colors. If, therefore, the duty factors of rectangular wave tone signals could be freely varied, then an electronic musical instrument would provide a more improved performance.

SUMMARY OF THE INVENTION

It is accordingly the object of this invention to provide a waveform converter capable of controlling the duty factor of an output rectangular wave tone signal on the basis of the frequency of an input rectangular wave tone signal.

According to a waveform converter of this invention, a frequency-voltage converter, when supplied with an input rectangular wave tone signal, produces a D.C. voltage control signal having a voltage level corresponding to the frequency of the input rectangular wave tone signal; and a one-shot multivibrator which is triggered by an input rectangular wave tone signal to produce an output rectangular wave tone signal is provided with duty-factor control means which defines the duty factor of the output rectangular wave tone signal in response to the D.C. voltage control signal.

DESCRIPTION OF THE PREFERRED EMBODIMENT

Figure 1:
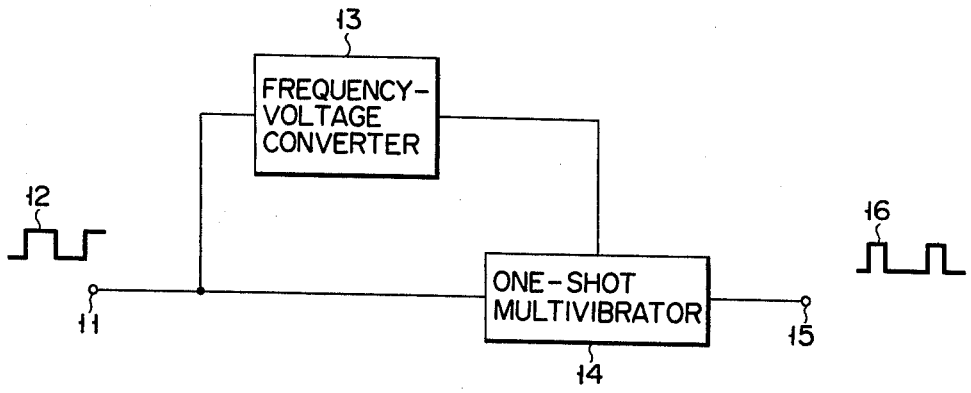
FIG. 1 is a block diagram of a waveform converter embodying this invention.

Referring to FIG. 1, referential numeral 11 denotes an input terminal adapted to receive an input rectangular wave tone signal 12 having a duty factor of, for example, 50%. The input rectangular wave tone signal 12 is supplied to a frequency-voltage converter 13 and a one-shot or monostable multivibrator 14. The frequency-voltage converter 13 produces an output voltage whose level corresponds to the frequency of the input rectangular wave tone signal 12. An output voltage from the frequency-voltage converter 13 is conducted to a variable duty factor control means included in the one-shot multivibrator 14. Therefore, an output rectangular wave tone signal generated by the one-shot multivibrator 14 when triggered by the input rectangular wave tone signal 12 has a duty factor determined by the output voltage from the frequency-voltage converter 13. At an output terminal 15 connected to the one-shot multivibrator 14 appears an output rectangular wave tone signal 16 having a different duty factor from that of the input rectangular wave tone signal 12. It will be noted that the input rectangular wave tone signal 12 and output rectangular wave tone signal 16 have the same repetitive frequency.

Figure 2:
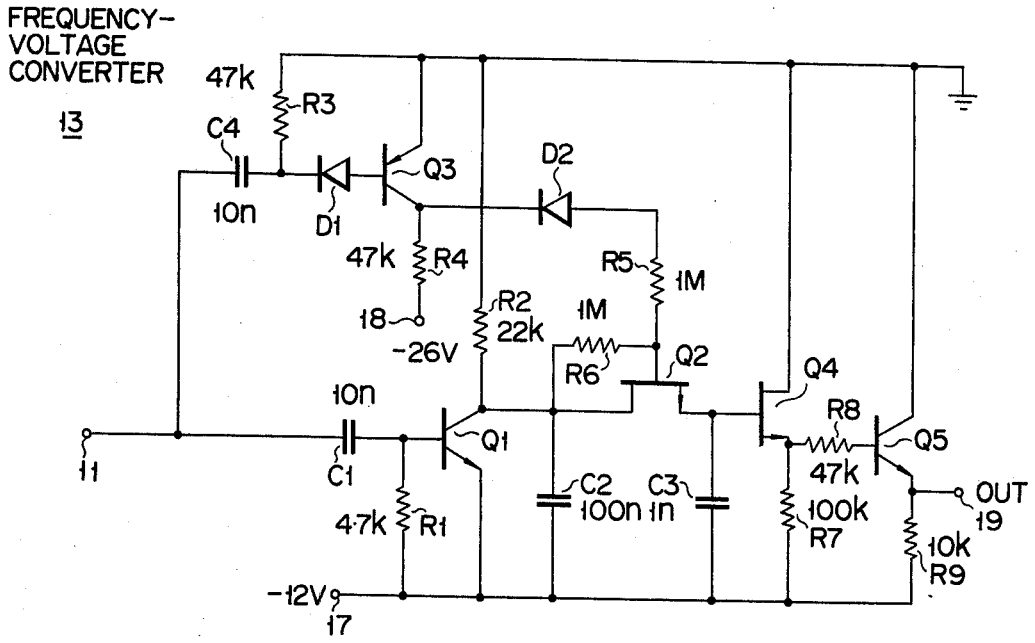
FIG. 2 is a circuit diagram of a frequency-voltage converter of FIG. 1.

FIG. 2 is a circuit diagram of a frequency-voltage converter included in the waveform converter of FIG. 1. A first differentiation circuit comprised of a capacitor C1 and resistor R1 is connected between the input terminal 11 and negative power supply terminal 17. The junction of the capacitor C1 and resistor R1 is connected to the base of an NPN transistor Q1 whose collector is connected to ground through a resistor R2 and whose emitter is connected to the negative supply terminal 17. A capacitor C2 is connected between the collector and emitter of transistor Q1. The collector of transistor Q1 is connected through a field effect transistor Q2 to one end of a capacitor C3, the other end of which is connected to the negative power supply terminal 17.

A second differentiation circuit comprised of a capacitor C4 and resistor R3 is connected between the input terminal 11 and ground. The junction of the capacitor C4 and resistor R3 is connected to the cathode of a diode D1. The anode of diode D1 is connected to the base of a PNP transistor Q3 whose emitter is grounded, and whose collector is connected to a negative power supply terminal 18 through a resistor R4. The collector of transistor Q3 is connected to the gate of the field effect transistor Q2 through a diode D2 and resistor R5. A biasing resistor R6 is connected between the collector of transistor Q1 and the gate of field effect transistor Q2.

An output voltage from the capacitor C3 is delivered to the outut terminal 19 of th frequency-voltage converter 13 through a high input impedance buffer circuit comprised of transistors Q4, Q5 and resistors R7, R8, R9.

Figure 3:
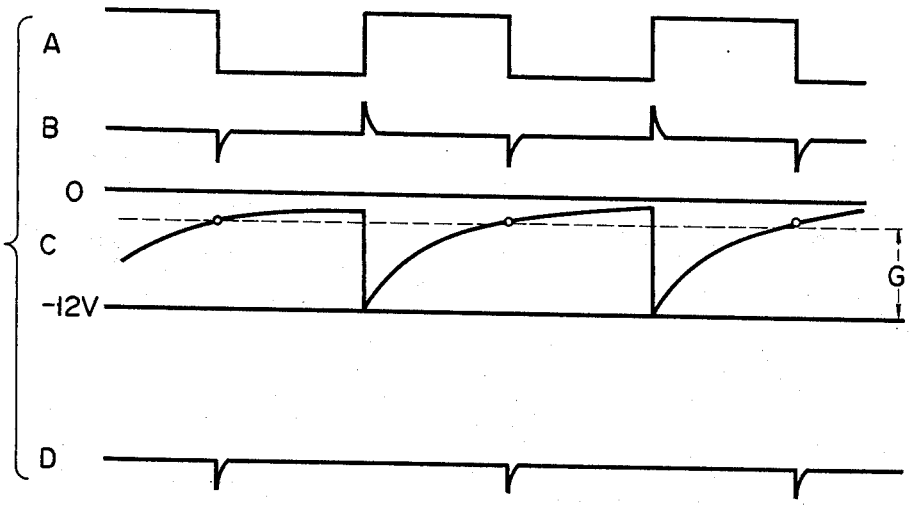
FIGS. 3 and 4 are waveform diagrams useful in explaining the operation of the frequency-voltage converter.
Figure 4:
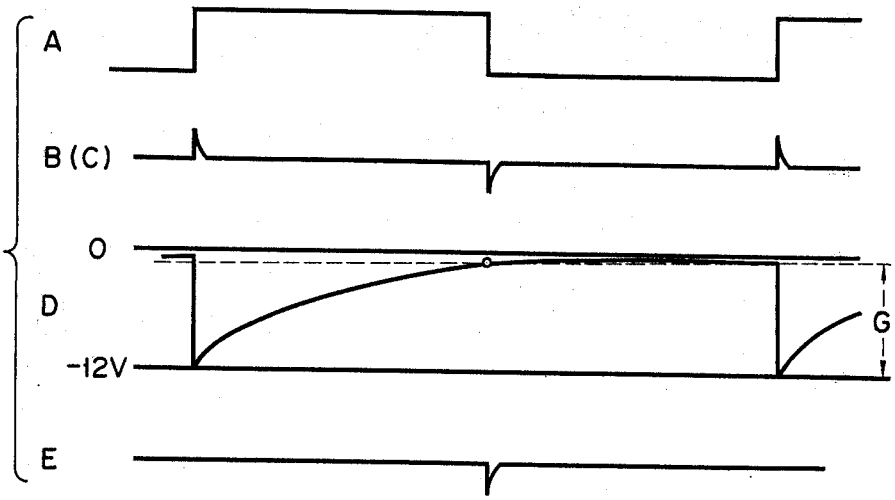

There will now be described by reference to FIGS. 3 and 4 the operation of the frequency-voltage converter 13 arranged as described above. When an input rectangular wave tone signal having a waveform shown in FIG. 3A is supplied to the input terminal 11 and thereafter differentiated by the first differentiation circuit comprised of the resistor R1 and capacitor C1 and the second differentiation circuit comprised of the resistor R2 and capacitor C2, then negative- and positive-going spike pulses are formed which correspond to the negative- and positive-going transitions of an input signal as shown in FIG. 3B. The positive-going ones of the spike pulses produced by the capacitor C1 and resistor R1 drive the transistor Q1 from cutoff into saturation causing the capacitor C2 immediately to be discharged. The transistor Q1 is in a cutoff condition during a time interval between the respective positive-going spike pulses. As the result, the capacitor C2 is charged from −12 volts toward zero volt as shown in FIG. 3C at a time constant defined by the values of resistor R2 and capacitor C2.

On the other hand, the transistor Q3 is driven by the negative-going ones (shown in FIG. 3D) of the spike pulses formed by the capacitor C4 and resistor R3 with the resultant transition of its collector voltage. The field effect transistor Q2 is enabled in response to the above-mentioned transition, causing the capacitor C3 to be coupled in parallel with the capacitor C2. At this point, the voltage of the capacitor C2 is transferred to the capacitor C3. The point of time at which the voltage of the capacitor C2 is to be transferred to the capacitor C3, namely, the point of time at which the field effect transistor Q2 is enabled depends on the frequency of the input rectangular wave tone signal 12. Therefore, the voltage level of the capacitor C2 to be transferred to the capacitor C3 which is indicated by G in FIG. 3C depends on the frequency of the input rectangular wave tone signal 12. Obviously, therefore, the output terminal 19 of the high impedance buffer circuit impressed with the voltage of the capacitor C3 produces an output voltage whose level is a function of the frequency of the input rectangular wave tone signal 12. FIG. 4 indicates a case in which the input rectangular wave tone signal 12 has a lower frequency than in FIG. 3. As seen from FIG. 4, the lower frequency of the input rectangular wave tone signal 12 causes an output voltage from the frequency-voltage converter 13 to become larger in the positive direction with the voltage level of −12 volts taken as the reference.

Figure 5:
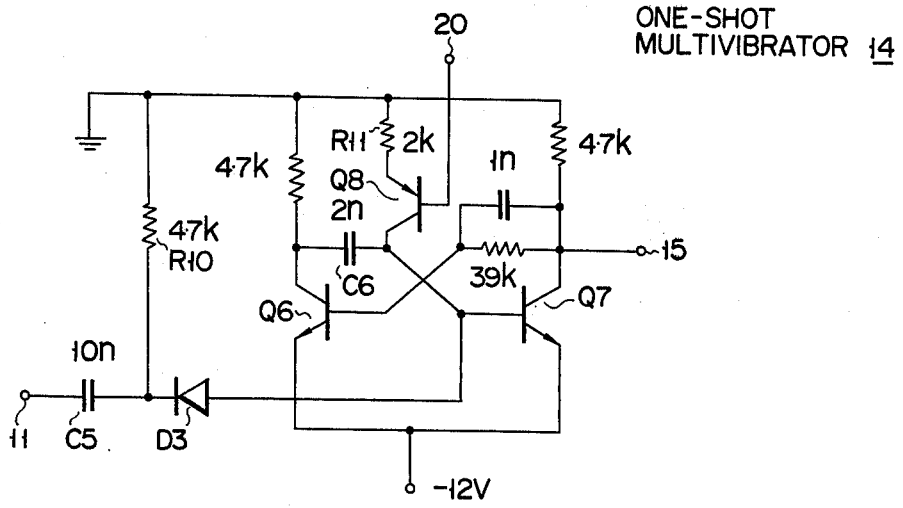
FIG. 5 is a circuit diagram of a one-shot multivibrator of FIG. 1.

FIG. 5 is a circuit diagram of a one-shot multivibrator 14 included in the waveform converter of FIG. 1. An input rectangular wave tone signal 12 supplied to the input terminal 11 is differentiated by a resistor R10 and capacitor C5. Due to the presence of a diode D3, negative-going spike pulses generated by the resistor R10 and capacitor C5 trigger a one-shot multivibrator comprising a pair of transistors Q6, Q7 which are cross-coupled to generate output pulses at an output 15 coupled to the collector of transistor Q7. A capacitor C6, resistor R11 and transistor Q8 jointly constitute duty factor control means of the multivibrator. The base of transistor Q8 is connected to a control terminal 20 coupled to the output terminal 19 of the frequency-voltage converter 13. Consequently, the transistor Q8 acts as a variable resistor element which presents a resistance corresponding to the level of an output voltage from the frequency-voltage converter 13 between the collector and emitter. Thus, it will be seen that the duty factor of an output rectangular wave tone signal generated at the output terminal 15 connected to the collector of the transistor Q7 becomes a function of resistance between the collector and emitter of the transistor Q8, namely, a function of the level of an output voltage from the frequency-voltage converter 13. Where a waveform converter comprises a frequency-voltage converter 13 and one-shot multivibrator 14, the circuit arrangements of which are indicated in FIGS. 2 and 5 respectively, then the duty factor of the rectangular wave output is more increased, as the frequency of the rectangular wave input is more reduced.

Figure 6:
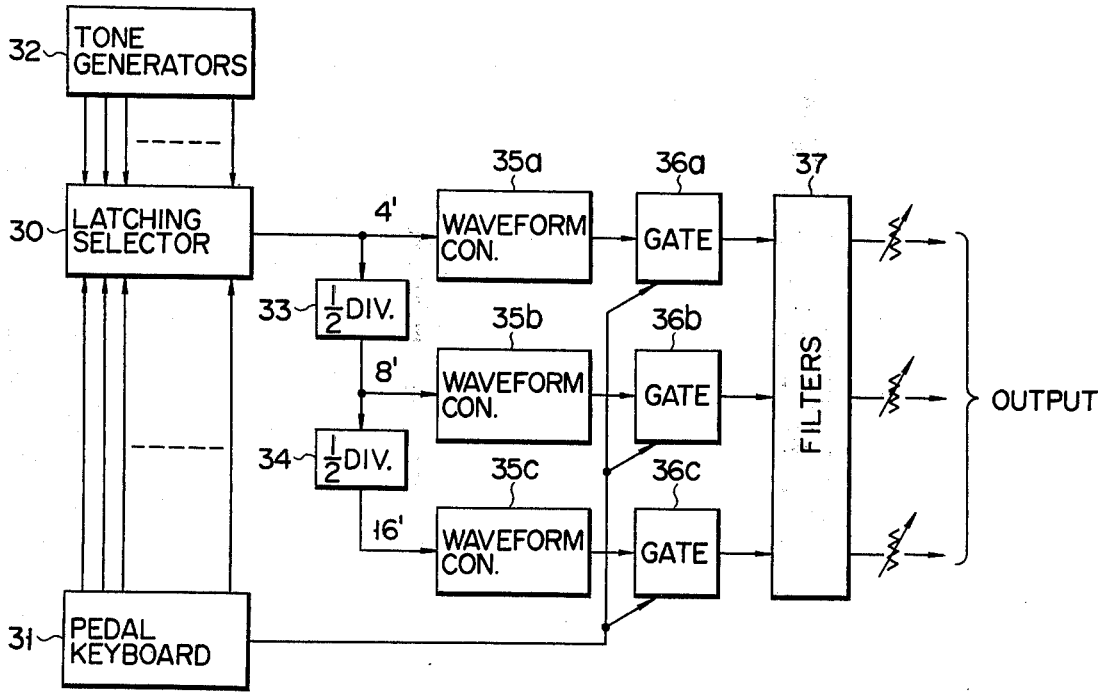
FIG. 6 is a block diagram of an electronic musical instrument using the waveform converter of this invention.

FIG. 6 shows an electronic musical instrument using the waveform converter of this invention. A known latching selector 30 selectively draws out from tone generators 32 a tone signal corresponding to the note of a depressed key on a pedal keyboard 31 and continues to store and draw out the tone signal thus selected until another key is operated. The tone signal derived from the latching selector 30 is successively subjected to frequency division by ½ dividers 33, 34 to provide 4′, 8′ and 16′ tone signals. These 4′, 8′ and 16′ tone signals are supplied to the corresponding waveform converters 35*a*, 35*b*, 35*c* of this invention to be converted into tone signals whose duty factors correspond to the respective frequencies. Output signals from the waveform converters 35*a*, 35*b*, 35*c* are sent forth to tone-coloring filters 37 through the known gates 36*a*, 36*b*, 36*c* enabled by the pedal keyboard 31. Output signals from the tone-coloring filters 37 are conducted to sound reproducing means (not shown).

What is claimed is:

1. A duty factor controlling waveform converter for use with an electronic musical instrument comprising: an input terminal for receiving an input rectangular wave tone signal; an output terminal; a frequency-voltage converter coupled to said input terminal to receive the input rectangular wave tone signal and produce a control voltage signal whose level corresponds to the frequency of the input rectangular tone signal; a one-shot multivibrator coupled between said input and output terminals to generate at said output terminal an output rectangular wave tone signal having the same frequency as the input rectangular wave tone signal, said one-shot multivibrator including a control terminal coupled to receive the control voltage signal and means responsive to the control voltage signal for determining the duty factor of the output rectangular wave tone signal to be produced by said one-shot multivibrator in accordance with the voltage level of the control voltage signal.

2. The waveform converter according to claim 1 wherein said frequency-voltage converter comprises a first capacitor and a first resistor coupled in series across a power supply source; first and second differentiating circuit means coupled to receive the input rectangular wave tone signal and each adapted to produce first and seccond spike pulses alternately in response to application of the input rectangular wave tone signal; a second capacitor; a switching means coupled in parallel with said first capacitor and responsive to application of the first spike pulse from said first differentiating circuit means to discharge said first capacitor; gate means coupled to said second differentiating circuit means and responsive to occurrence of the second spike pulse from said second differentiating circuit means to couple said second capacitor in parallel with said first capacitor.

* * * * *